US005171317A

United States Patent [19]

Corcoran

[11] Patent Number: 5,171,317

[45] Date of Patent: Dec. 15, 1992

[54] READILY ADJUSTABLE THERAPEUTIC TRACTION CHAIR

[76] Inventor: Joseph D. Corcoran, 12888 Valewood Dr., Naples, Fla. 33999

[21] Appl. No.: 873,109

[22] Filed: Apr. 24, 1992

[51] Int. Cl.[5] ..... A61H 1/02

[52] U.S. Cl. ..... 606/241; 482/134; 297/417

[58] Field of Search ..... 297/417, 412, 353, 314, 297/344; 602/32-35; 606/237-245; 482/134, 142

[56] References Cited

U.S. PATENT DOCUMENTS

| | | | |
|---|---|---|---|
| 1,731,709 | 10/1929 | Cropsey | 297/417 X |
| 1,734,179 | 11/1929 | Olson | 297/353 X |
| 3,596,655 | 8/1971 | Corcoran | 602/32 |
| 3,675,646 | 7/1972 | Corcoran . | |
| 3,768,464 | 10/1973 | Greissing | 602/32 |
| 3,829,159 | 8/1974 | Leffler | 297/417 |
| 4,277,102 | 7/1981 | Aaras et al. | 297/417 X |
| 4,583,532 | 4/1986 | Jones | 602/32 |
| 4,660,885 | 4/1987 | Suhr et al. | 297/353 |
| 4,688,557 | 8/1987 | Bradstreet . | |
| 4,834,457 | 5/1989 | Head | 297/412 X |
| 4,846,527 | 7/1989 | Julien et al. | 297/417 X |
| 5,088,476 | 2/1992 | Burton | 606/241 |

*Primary Examiner*—Robert Bahr

*Assistant Examiner*—Linda C. M. Dvorak

*Attorney, Agent, or Firm*—Alvin S. Blum

[57] ABSTRACT

A chair has two parallel posts extending upward from the seat. A pair of housings slide up and down on the posts. Each housing supports a pair of padded arms pivoted on opposed ends of the housing to swing through a horizontal plane. Each arm on the lower housing may be locked against pivoting. Each housing may be locked at a vertical level by a housing locking mechanism. The user is seated on the seat with the posts behind the back. The lower housing is adjusted vertically so that the padded arms engage the upper margin of the pelvis and the arms and lower housing are locked in place. The upper housing is adjusted so that its padded arms engage the armpits and it is locked at that elevation. When the user's arms are forced down on the upper padded arms, the spine is stretched between the upper and lower housing pulling up on the shoulder girdle and holding the pelvic girdle down. Toothed racks mounted on the posts cooperate with locking meohanisms in the housings to lock a housing on both posts simultaneously for ease of operation by the user and the user controls the amount of stretching applied to the spine for treatment of various spinal problems in which traction is required. A unique double-acting ratchet locking mechanism operates automatically to lock the housing.

7 Claims, 2 Drawing Sheets

FIG. 1
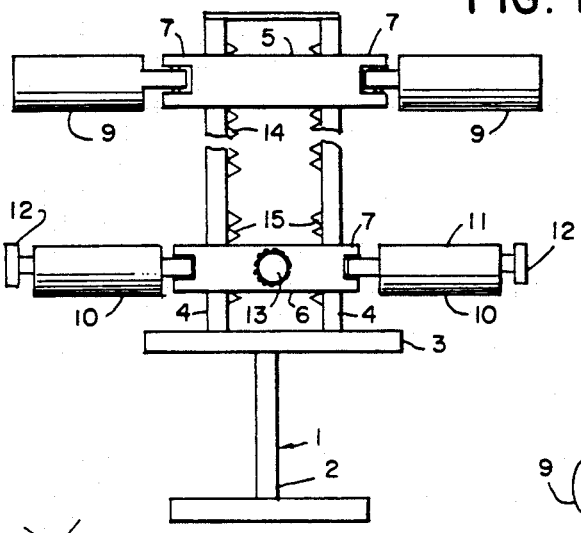
FIG. 2
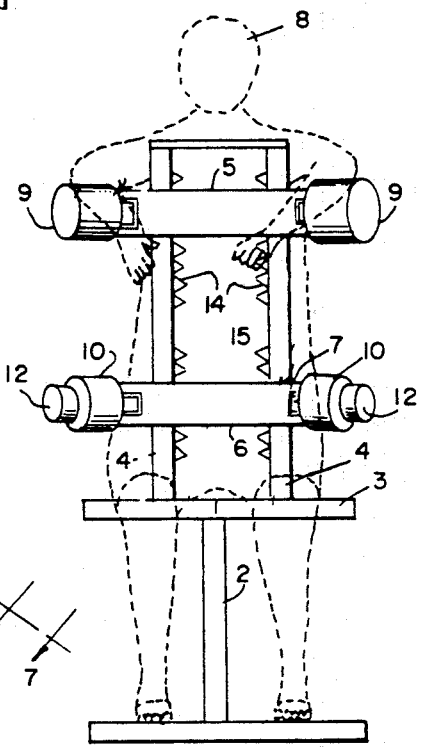
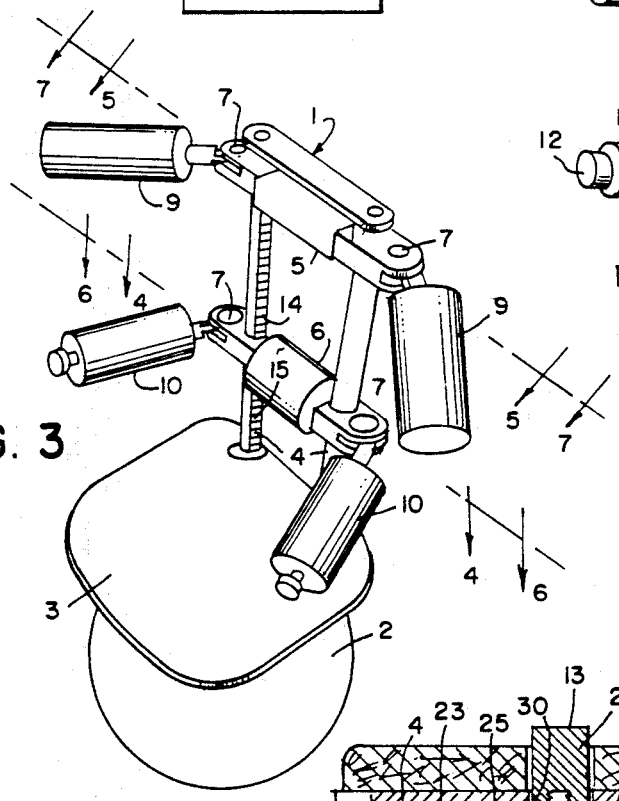
FIG. 3
FIG. 6
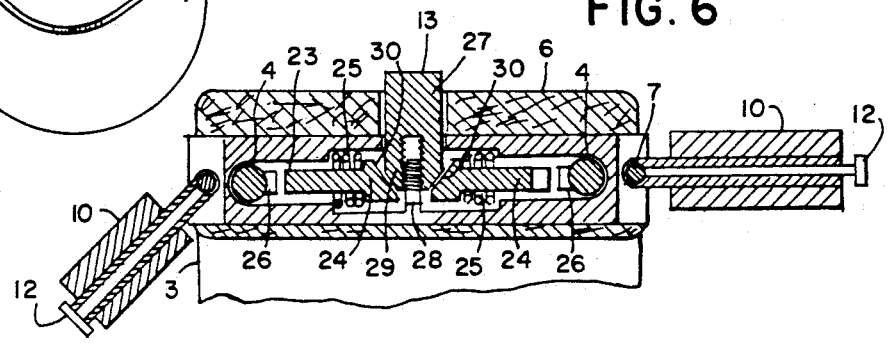

FIG. 7
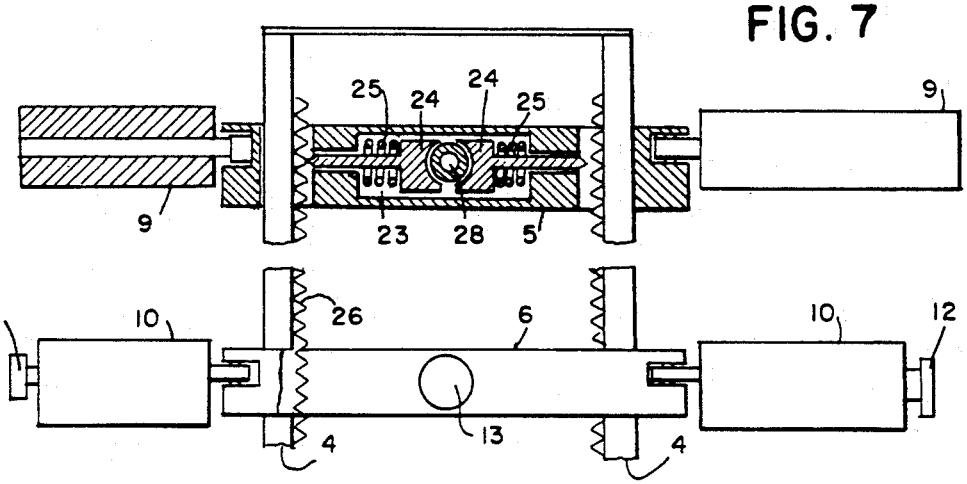
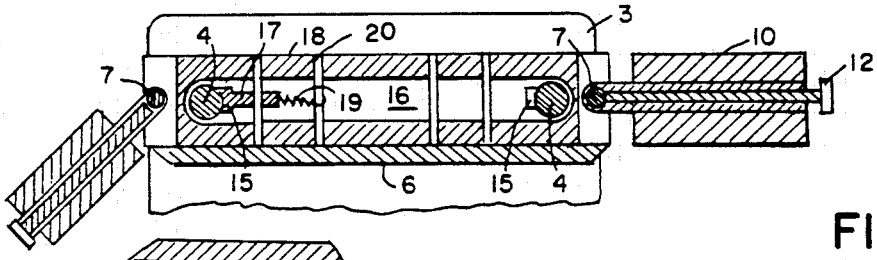
FIG. 4
FIG. 5A
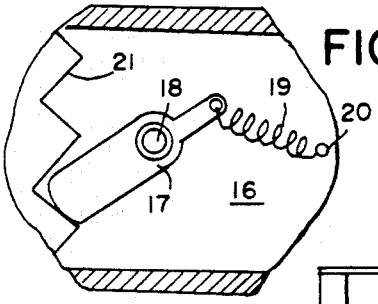
FIG. 5B
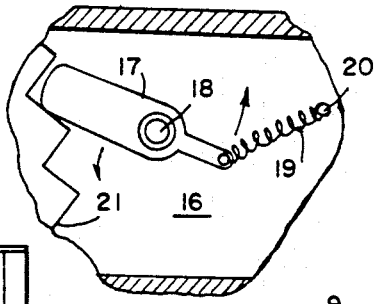
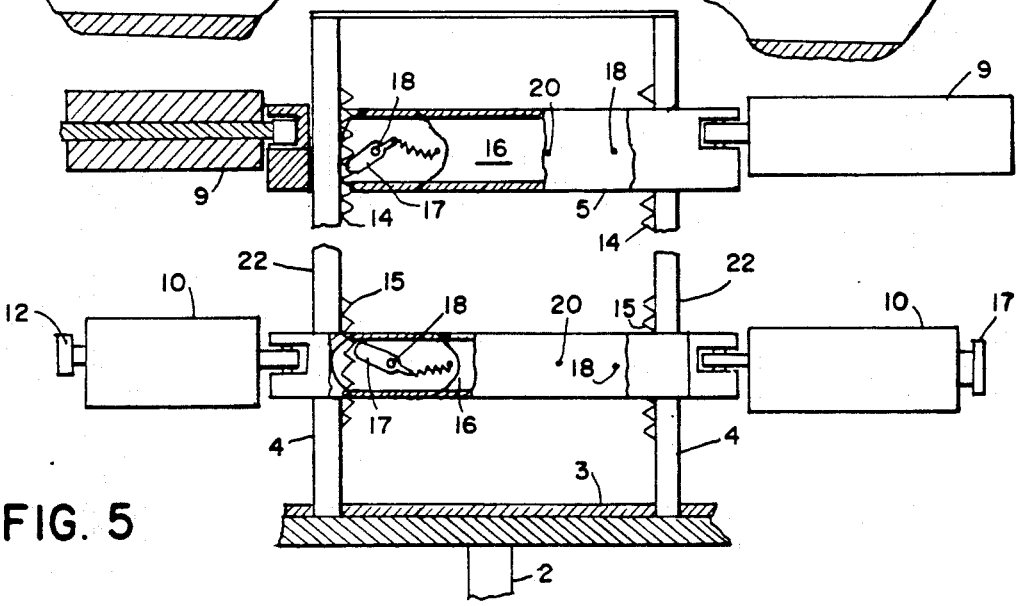
FIG. 5

READILY ADJUSTABLE THERAPEUTIC TRACTION CHAIR

BACKGROUND OF THE INVENTION

This invention relates to therapeutic traction devices and more particularly to a chair that fixes the pelvic girdle and applies traction to the spine through lifting of the shoulder under the direct control of the patient.

In the treatment of orthopedic disorders of the back and spine, it has long been recognized that relief of pain and long term benefit often results from placing the spine in traction or extension. A well known method is to strap a harness about the pelvis and another harness about the thorax. These are then pulled in opposite directions by weights on pulleys, springs, motors and the like. Apparatus of this type is exemplified by the U.S. Pat. Nos. 4,466,427, 4,356,816 and 4,664,101. These devices are awkward and time-consuming to apply. They are especially awkward for females, because the breasts interfere.

U.S. Pat. No. 4,688,557 issued Aug. 25, 1987 to Bradstreet discloses a chair with arm supports extending from the backrest and under the armpits. The seat adjustably drops down so that the weight of the body is supported only by the armrests and tension on the spine is determined by the body weight.

U.S. Pat. No. 3,675,646 issued Jul. 11, 1972 to the Applicant discloses a chair with a housing for engaging the hips and another housing for engaging the armpits. The housings are supported on parallel posts with racks and the housings are adjusted vertically by crank-operated worm gears engaging the racks. The cranks must be operated from the rear, there are no means of locking the housings at a particular level, and the mechanism is costly to produce.

It would be useful to produce a chair that would hold the pelvic girdle in place and pull upward on the shoulder girdle that would be easily adjusted and operated by the patient, and that would be simple and economical to manufacture.

SUMMARY OF THE INVENTION

It is accordingly an object of the invention to provide a traction chair that will hold the pelvic girdle in place and lift the body upward from beneath the armpits with apparatus that is readily adjusted and controlled by the patient, even while seated in the chair. It is another object that the chair be of simple inexpensive and durable construction with adjustments that may be easily made without special skills or tools to fit a variety of body types with adjustments that are comfortable for a variety of patients of either sex and with a variety of spinal problems such as back spasm, vertebral compression, and scoliosis.

The traction chair of the invention comprises a standard supporting a padded seat, a pair of parallel vertical posts extending upward from the seat. Each post is provided with a toothed rack, the two racks facing each other. Slidably supported on both posts are two housings. At the two ends of each housing, a padded elongate roller is pivotally connected with a vertical pivot axis so that the padded elongate roller moves through a plane perpendicular to the axis of the posts. The padded members of the lower housing are swung in at the hips and locked in place over the pelvic girdle by locking knobs at the ends of the rollers, after vertical adjustment of the housing. The upper housing is raised up and its padded rollers swung in to engage the armpits. The upper and lower housings are locked in place on the vertical posts. The arms can now be pressed against the upper rollers to apply a lifting force to the shoulder girdle to thereby apply traction to the spine in a patient controlled manner while the lower rollers prevent the pelvic end of the spine from being raised. This mechanism stretches more of the upper spine than the thoracic harness apparatus, which is especially important in scolisis therapy. A unique mechanism is employed for locking the housings on the posts that is simple to operate and inexpensive to manufacture. This locking mechanism must be able to resist the tremendous forces applied by the patient yet be readily adjusted and locked in position.

These and other objects, features and advantages of the invention will become more apparent when the detailed description is considered in conjunction with the drawings, in which:

BRIEF DESCRIPTION OF THE DRAWINGS

FIG. 1 is a rear elevation view of the chair of the invention with rollers open.

FIG. 2 is a front elevation view of the chair with rollers in operating position and with a patient shown in phantom.

FIG. 3 is a perspective view of the chair.

FIG. 4 is a sectional view taken through 4—4 of FIG. 3.

FIG. 5 is a sectional view taken through 5—5 of FIG. 3.

FIGS. 5A and 5B show elements of the invention.

FIG. 6 is a sectional view taken through 6—6 of FIG. 3 of an alternate housing locking mechanism of the invention.

FIG. 7 is a sectional view taken through 7—7 of FIG. 3 of the alternate housing locking mechanism of the invention of FIG. 6.

DETAILED DESCRIPTION OF PREFERRED EMBODIMENTS

Referring now first to FIGS. 1-3, the traction chair 1 of the invention comprises a support or standard 2. Fixed to the support is a seat 3. Two parallel posts 4 are fixed to seat 3 and extend vertically upward therefrom. Slidably mounted on the posts are a first housing 5 for engaging the axillae or shoulder girdle and a second housing 6 for engaging the hips or pelvic girdle of a user 8 (shown in phantom, FIG. 2). At opposed ends of first housing 5, a vertical pivot axle 7 pivotally connects to an elongate, padded roller or arm 9 which moves freely in a plane perpendicular to the long axis of each post.

At opposed ends of the second housing 6, a vertical pivot axle 7 pivotally connects to an elongate, padded roller or arm 10 which moves freely in a plane perpendicular to the long axis of the posts 4. At the free end 11 of each arm 10 is a fixing knob 12 which may be turned one way to enable the arm 10 to swing freely and a second way to fix the arm on the pivot axle 7 so that it remains fixed in horizontal position against the top of the hip bone of the user.

The vertical position of the two housings 5, 6 are adjusted by simply sliding up and down on the posts. Two locking mechanisms are shown for fixing the vertical position of the housings once they have been positioned as required, both locking mechanisms employ the toothed rack members 14, 15 on posts 4. A ratchet type automatic locking system is shown in FIGS. 4, 5 and a manual locking system is shown in FIGS. 6, 7 that uses manual manipulation of a lock knob 13 shown on the rear of the second housing 6 of FIG. 1, while the first housing 5 is shown devoid of a lock knob as would be the appearance with the automatic ratchet type locking system.

With either system, the lower housing 6 is adjusted and locked in position with the arms 10 swung in to engage the top of the hips and fixed with fixing knobs 12. Then the upper housing 6 is adjusted so that the arms 9 just engage the axillae or armpits and the user's arms are lowered onto the padded arms 9 to provide an upward force on the shoulder girdle that is fully controlled by the user. Since the pelvic girdle is held down by the arms 10, the spine is stretched between shoulders and pelvis without complex belts, harnesses or adjustments.

Referring now to the automatic, two way ratchet locking system for adjustably securing the vertical position of sliding housings 5 and 6, details are shown in FIGS. 4 and 5.

In a hollow channel 16 within each housing 5 and 6, a pair of pawls 17 are pivotally mounted on horizontal pawl axles 18, one pawl on each side of the housing arranged for interacting with the toothed racks mounted on the posts 4. Upper rack portions 14 cooperate with the pawls 17 in the first housing 5 for engaging the shoulder girdle and lower rack portions 15 cooperate with the pawls 17 in the second housing 6 for engaging the hips. A tension spring 19 connected between pawl 17 and spring anchor pin 20 biases the pawl so that it tends to assume a horizontal position when unobstructed. It is prevented from assuming the horizontal position by the rack whenever the housing is in line with a rack. When so engaged, the pawl interacts with the rack to provide a rachet action in which the housing is free to slide in one direction and prevented from sliding in the opposite direction. As seen in FIG. 5, the pawls 17 of upper housing 5 are in a position whereby the housing 5 may be raised but not lowered. The lower housing 6 has pawls positioned in the opposite direction so that the housing 6 may be lowered, but not raised by its interaction with lower rack portions 15. These are the desired modes of operation when the user is seated in the chair and the housings are ready to be adjusted to the user's body. The lower housing must be lowered onto the hips with the arms swung inward and locked in securely in place to resist lifting forces. Only the fixing knobs 12 at the ends of arms 10 need to be locked, the housing 6 is locked automatically by the ratchet system. Then the upper housing is raised up with padded arms or rollers 9 swung under the armpits or axillae to the appropriate level so that when the user's arms are forced against the padded rollers 9, the ratchet mechanism will prevent even very great forces on the arms 9 from lowering the housing 5.

As shown in FIGS. 5A and 5B, a double acting ratchet mechanism enables the housings to move in the opposite direction, by simply moving the housing in the allowed direction until the end of the rack is reached. Then the direction of permitted motion is reversed until the opposite end of the rack portion is passed, because the spring 19 is then able to pull the pawl into the horizontal position and is ready to be swung in the opposite direction by the teeth 21 of the rack. FIG. 5 shows one pawl in each position and also a portion of the housings covered. When the racks are aligned on the posts, the pawls will lock onto the racks on both posts simultaneously, requiring no special locking operations or skills. They can be adjusted by the user while seated and removed just as easily. Consequently, the user can avail himself of treatment for brief periods with very little time or effort.

The stops 22 mounted on posts 4 prevent the housing from sliding onto the adjacent rack when resetting the pawls.

Referring now to the manual locking system for securing the vertical position of the housings 5 and 6 on the posts 4, details of the structure are shown in FIGS. 6 and 7.

Within a channel 23 in each housing are a pair of horizontally mounted, sliding bolts 24. Compression springs 25 normally bias the bolts away from the teeth of the racks 26. Manual lock control 27 is threadably engaged on threaded stud 28 affixed to the housing. It has a tapered body portion 29 for engaging the tapered inner ends 30 of the sliding bolts 24. Lock control 27 is operated by knob 13 at its outer end. As it is screwed in, its tapered body portion 29 cooperates with the tapered end of each bolt simultaneously, forcing the bolts against the springs and into meshing contact with the teeth of the racks 26 to lock the housing onto both posts simultaneously. Unscrewing the knob releases the lock as the bolts are forced away from the racks by the springs 25.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A traction chair comprising:

A) a support means for supporting said chair on a supporting surface;

B) a seat supported by said support means;

C) a pair of posts affixed to said seat parallel to one another and extending upward from said seat;

D) a first housing for elevating the shoulder girdle of a user, said first housing slidably supported on both said posts for vertical adjustment thereon;

E) a first locking means mounted on said first housing for adjustably fixing said first housing at a particular elevation on said posts;

F) a pair of padded first arms, each one pivotally attached to an opposed end of said first housing for free movement in a plane perpendicular to the long axes of said posts, said first arms arranged for engaging the axillae and arms of a user;

G) a second housing for restraining the pelvic girdle of a user from upward movement, said second housing slidably supported on both said posts for vertical adjustment thereon;

H) second locking means mounted on said second housing for adjustably fixing said second housing at a particular elevation;

I) a pair of padded second arms, each one pivotally attached at a pivot end to an opposed end of said second housing for free movement in a plane perpendicular to the long axes of said posts, said second arms arranged for engaging the upper end of the hips of a user, and each arm provided at a free end with fixing means, said fixing means arranged for preventing free pivotal movement of said second arm by manipulation by a seated user; and J) a pair of toothed rack means for engaging said first and second locking means, each rack means connected to one of said posts and extending parallel to the long axis thereof, each said locking means arranged for engaging both said rack means simultaneously for ease of operation.

2. The chair according to claim 1, in which said seat is supported in a fixed vertical position on said support means.

3. The chair according to claim 2, in which each rack means is on an inner aspect of said post and facing one another.

4. The chair according to claim 1, in which each said lock means includes a pair of pawls, each pawl normally biased away from one of said rack means and a single control member arranged for forcing each said pawl simultaneously into engagement with said rack means to thereby lock said housing vertically on both posts with a single control operation.

5. The chair according to claim 3, in which each said lock means includes a pair of pawls, each pawl normally biased away from one of said rack means and a single control member arranged for forcing each said pawl simultaneously into engagement with said rack means to thereby lock said housing vertically on both posts with a single control operation.

6. The chair according to claim 1, in which each said lock means includes a pair of biased pawls, each pawl cooperating with one of said rack means to provide a double-acting linear ratchet means whereby the ratchet means enables free sliding in a first vertical direction and resists sliding in a second vertical direction until the pawl passes the end tooth of a particular rack portion and then enables free sliding in the second direction and resists sliding in the first direction until the pawl passes the end tooth of the opposite end of said particular rack portion.

7. The chair according to claim 6, in which each rack means is divided into two rack portions: an upper rack portion for cooperating with said first housing to provide a pair of said double acting linear ratchet means; and a lower rack portion for cooperating with said second housing to provide a pair of double acting linear ratchet means, whereby said second arms are adjusted to hip level by simply lifting up the second housing until the top of the lower rack portion is passed and then lowering the second housing to the desired level while moving the second arms inward and locking the second arms in place by said fixing means at the free ends of the arms, with the second housing remaining fixed against elevation by said ratchet means automatically and said first arms are adjusted to axialla level by simply lowering the first housing until the bottom of the upper rack portion is passed and then raising the first housing to the desired level with the first housing remaining fixed against lowering by said ratchet means automatically.

* * * * *